US009327806B2

(12) United States Patent
Howard et al.

(10) Patent No.: US 9,327,806 B2
(45) Date of Patent: May 3, 2016

(54) DRILLING SHIP FOR A POLAR REGION

(75) Inventors: Norman D. Howard, Houston, TX (US); Gi Yun Lee, Geoje Si (KR); Hun Gi Lee, Gyeonngi-Do (KR)

(73) Assignees: DAEWOO SHIPBUILDING & MARINE ENGINEERING CO., LTD., Seoul (KR); TRANSOCEAN SEDCO FOREX VENTURES LIMITED, George Town (KY)

( * ) Notice: Subject to any disclaimer, the term of this patent is extended or adjusted under 35 U.S.C. 154(b) by 257 days.

(21) Appl. No.: 13/882,735

(22) PCT Filed: Jun. 28, 2011

(86) PCT No.: PCT/KR2011/004691
§ 371 (c)(1),
(2), (4) Date: Dec. 19, 2013

(87) PCT Pub. No.: WO2012/060531
PCT Pub. Date: May 10, 2012

(65) Prior Publication Data

US 2014/0102345 A1 Apr. 17, 2014

(30) Foreign Application Priority Data

Nov. 1, 2010 (KR) ..... 10-2010-0107702

(51) Int. Cl.
*B63B 35/44* (2006.01)

(52) U.S. Cl.
CPC ..... *B63B 35/4413* (2013.01)

(58) Field of Classification Search
CPC ..... B63B 35/4413
See application file for complete search history.

(56) References Cited

U.S. PATENT DOCUMENTS 3,023,808 A * 3/1962 St John ..... 175/209
3,618,679 A 11/1971 Crooke (Continued)

FOREIGN PATENT DOCUMENTS

JP 59-223593 A 12/1984
JP 60-126589 U 8/1985

(Continued)

OTHER PUBLICATIONS

Office Action dated Feb. 18, 2014 of corresponding Japanese Patent Application 2013-536486—2 pages.

(Continued)

*Primary Examiner* — Edwin Swinehart
(74) *Attorney, Agent, or Firm* — Knobbe Martens Olson & Bear LLP

(57) ABSTRACT

Provided is an arctic drill ship in which a weather tight structure protecting a drill floor and a drilling work area from outside air is coupled to a side strake around the drilling work area. It is possible to economically and easily manufacture the weather tight structure which minimizes the influence of outside air on the drilling operation in the polar regions, and it is possible to efficiently support the hull longitudinal strength and the weather tight structure with the use of the side strake structure solely. Therefore, a structure which may cause a disturbance in the drilling work area is minimized, and it is unnecessary to install a separate structural reinforcement part for a drilling workspace in the polar regions. In addition, the drilling workspace in the polar regions can be effectively ensured, and a spatial limitation in an upper portion of a moonpool can be solved.

7 Claims, 3 Drawing Sheets

(56) References Cited

U.S. PATENT DOCUMENTS

| | | | |
|---|---|---|---|
| 3,749,162 | A | 7/1973 | Anders |
| 4,613,001 | A | 9/1986 | Edberg et al. |
| 6,068,069 | A | 5/2000 | Scott et al. |

FOREIGN PATENT DOCUMENTS

| | | | |
|---|---|---|---|
| JP | 03-005197 | Y2 | 2/1991 |
| JP | 05-005717 | B2 | 1/1993 |
| JP | 3868902 | B2 | 1/2007 |
| WO | 95/24337 | A1 | 9/1995 |

OTHER PUBLICATIONS

International Search Report dated Feb. 17, 2012 of PCT/KR2011/004691 which is the parent application—4 pages.

International Search Report dated Feb. 17, 2012 of related PCT Application No. PCT/KR2011/004690—4 pages.

Office Action dated Feb. 18, 2014 of related Japanese Patent Application 2013-536485—3 pages.

* cited by examiner

DRILLING SHIP FOR A POLAR REGION

CROSS-REFERENCE(S) TO RELATED APPLICATION

This application claims priority of Korean Patent Application No. 10-2010-0107702, filed on Nov. 1, 2010, in the Korean Intellectual Property Office, which is hereby incorporated by reference in its entirety.

BACKGROUND OF THE INVENTION

1. Field of the Invention

The present invention relates to an arctic drill ship, and more particularly, to an arctic drill ship in which a weather tight structure minimizing the influence of outside air on a drilling operation in polar regions can be installed economically and easily and a structure causing a disturbance in the drilling work area is minimized.

2. Description of the Related Art

Generally, a drill ship is a generic term for ships that explore and drill marine resources such as oil or gas, and examples of the drill ship include a fixed type platform, a semi-submersible drill ship, and so on.

With the rapid development of technologies necessary to explore and drill oil and natural gas buried under the seabed, the working area of the drill ship has expanded from a shallow area such as a continental shelf having a depth of about 200 m to an area having a poor environment such as a deep sea or a polar region having a depth of 2,000 m or more.

FIG. 1 is a cross-sectional view illustrating a conventional drill ship. In the conventional drill ship 10, as illustrated in FIG. 1, a drill floor 12 is provided on a deck 12 of a hull 11, and a derrick 13 is fixed to the drill floor 12. The derrick 13 is a large complicated structure provided with beams and a variety of drilling equipments. A large moonpool 14 such a drill well is formed in the hull 11 in order for installation of drilling equipments.

In the case where such a conventional drill ship is operated in a polar region, the drilling equipment and the workspace are exposed to a low-temperature outside air and thus it is difficult to perform the drilling operation. Therefore, it is necessary to enclose the drilling equipment and the workspace such that they are not exposed to outside air.

However, in the case of the drill ship, main drilling equipments are extensively disposed in a rig floor, a hurricane deck, and a moonpool zone, it is difficult to enclose the drilling work area through a hull structure of a conventional drill ship. It is uneconomical and there is an unavoidable problem in that structures causing interference dangers during operations are disposed, when considering drilling operation characteristics.

SUMMARY OF THE INVENTION

An aspect of the present invention is directed to an arctic drill ship in which a weather tight structure as a concept of a single compartment is made from a side strake or a position near to the side strake to an upper portion of a hurricane deck, thereby minimizing the influence of outside air on a drilling operation in polar regions and minimizing a structure that disturbs a drilling work area.

According to an embodiment of the present invention, an arctic drill ship is characterized in that a left wall and a right wall of a weather tight structure are coupled a side strake around a drilling work area, and a front wall and a rear wall of the weather tight structure are coupled to a hurricane deck at the front and rear of the drilling work area, so as to protect a drill floor and a drilling work area from outside air, and a reinforcement part installed to reinforce a drilling load applied to the weather tight structure is coupled to the left wall, the right wall, the front wall, and the rear wall of the weather tight structure.

The reinforcement part of the weather tight structure may have a grillage girder system.

The reinforcement part may form a lower structure of the drill floor.

Both sides of the drill floor may extend up to a position corresponding to a width of a hull.

Bottoms of the left wall and the right wall may be coupled to form the same plane on the side strake.

DETAILED DESCRIPTION OF EXEMPLARY EMBODIMENTS

Exemplary embodiments of the present invention will be described below in detail with reference to the accompanying drawings. The present invention may, however, be embodied in different forms and should not be construed as limited to the embodiments set forth herein.

Figure 1:
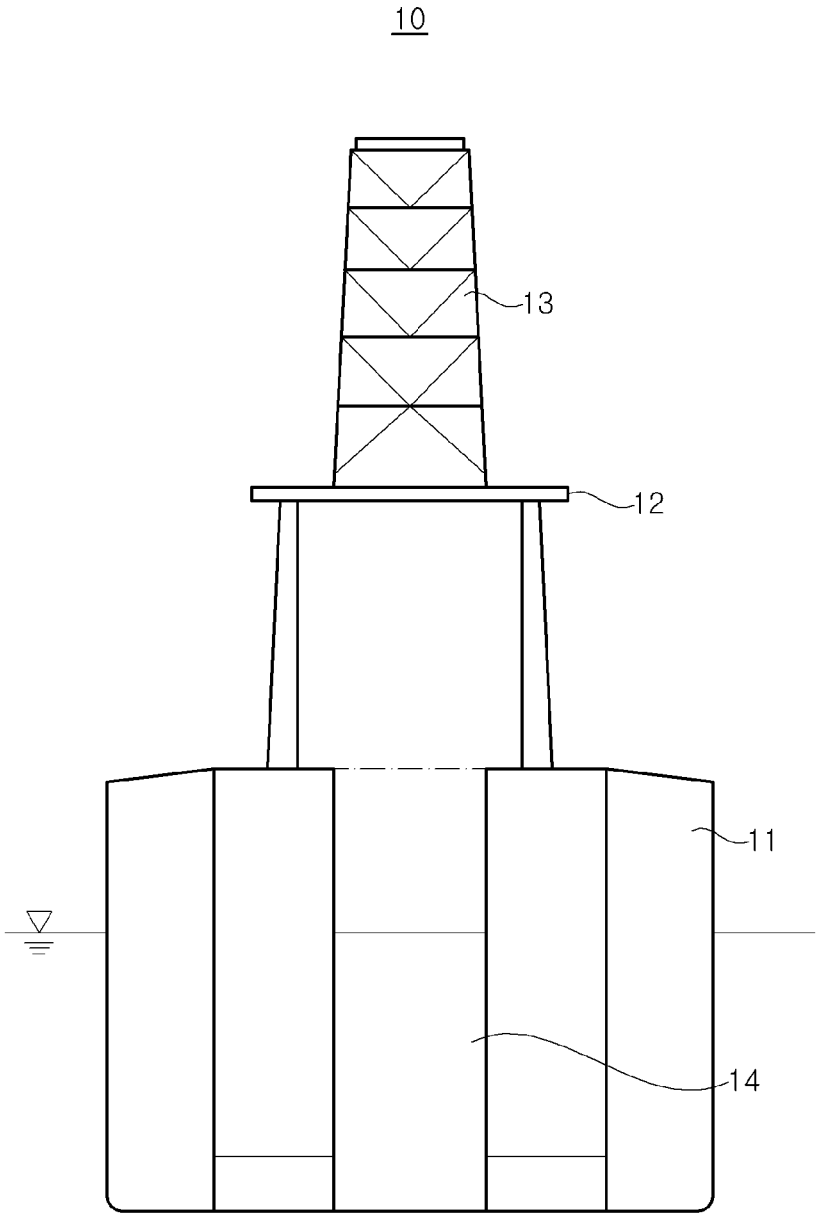
Fig. 1 PRIOR ART
FIG. 1 is a cross-sectional view illustrating a conventional arctic drill ship.
Figure 2:
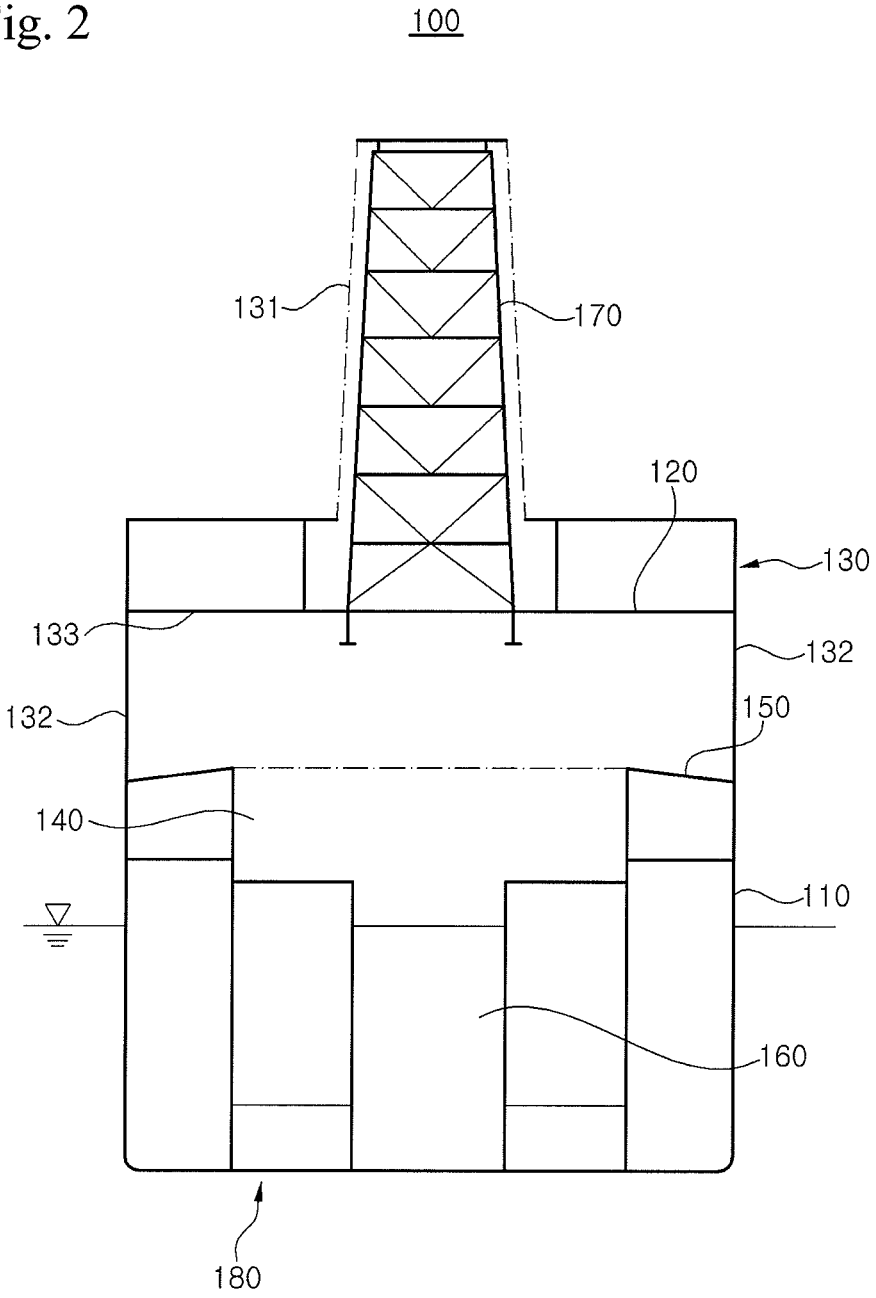
FIG. 2 is a cross-sectional view illustrating an arctic drill ship according to the present invention.
Figure 3:
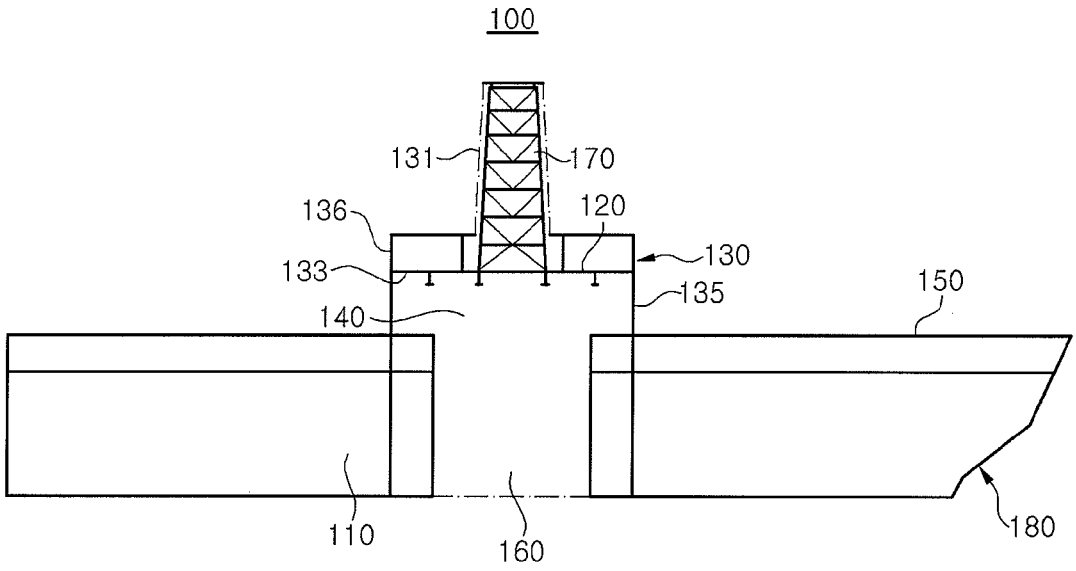
FIG. 3 is a longitudinal sectional view illustrating the arctic drill ship according to the present invention.

FIG. 2 is a cross-sectional view illustrating an arctic drill ship according to the present invention, and FIG. 3 is a longitudinal sectional view illustrating the arctic drill ship according to the present invention.

As illustrated in FIGS. 2 and 3, the arctic drill ship 100 according to the present invention is a drill ship that can be operated in polar regions. A weather tight structure 130 protecting a drill floor 120 and a drilling work area 140 from outside air is coupled to a side strake 110 around the drilling work area 140.

The weather tight structure 130 is manufactured to surround the drill floor 120 and the drilling work area 140 in order for their protection from outside air. As illustrated in FIG. 2, left and right walls 132 are provided at the left and right sides of the weather tight structure 130. The left and right walls 132 are coupling parts that extend downward and connect to the side strake 110. As illustrated in FIG. 3, a front wall 135 and a rear wall 136 are provided at the front and rear of the weather tight structure 130.

The bottoms of the left and right walls 132 may be coupled together on the side strake 110 such that they form an approximately same plane by using a welding or a separate coupling member. Meanwhile, the bottoms of the front wall 135 and the rear wall 136 may be coupled together on a hurricane deck 150 by using a welding or a separate coupling member. Although FIG. 3 illustrates that the bottoms of the front wall 135 and the rear wall 136 form a right angle with the hurricane deck 150, it is apparent that at least one of the front wall 135 and the rear wall 136 may be coupled to the hurricane deck 150 in a manner such that they are inclined.

Therefore, the weather tight structure 130 blocks a zone ranging from the moonpool 160 to the drill floor 120 from outside air and is easily installed in a hull 180.

A derrick 170 is fixed to an upper portion of the drill floor 120. Both sides of the drill floor 120 may extend up to a position corresponding to the width of the hull 180 in order to ensure the drilling work area 140, minimize a structure causing a disturbance in the drilling work area 140, and stably support the weather tight structure 130. Accordingly, the weather tight structure 130 also has the width corresponding to the hull 180 of the weather tight structure 130.

The weather tight structure 130 may include a reinforcement part 133 having a grillage girder system in order to stably support a weight of the derrick 170 or the like. The reinforcement part 133 may form a lower structure of the drill floor 120 and may be manufactured using the left and right walls 132 and the front and rear walls 135 and 136 (that is, longitudinal both-end structure of the weather tight structure 130). The reinforcement part 133 reinforces a drilling load applied to the weather tight structure 130.

In addition, the weather tight structure 130 may include a blocking section 131 enclosing the derrick 170 that protrudes upward. Therefore, it is possible to prevent outside air from being entered or exited through the derrick 170.

The operation of the arctic drill ship according to the present invention will be described below.

Since the weather tight structure 130 surrounding the drill floor 120 and the drilling work area 140 is coupled to the side strake 110, the hull longitudinal strength and weather tight structure 130 can be easily installed. Therefore, all zones ranging from the moonpool 160 to the drill floor 120 are protected from outside air by the weather tight structure 130.

In addition, since the left and right walls 132 of the weather tight structure 130 are coupled to the side strake 110 and the front and rear walls 135 and 136 of the weather tight structure 130 are coupled to the hurricane deck 150, the grillage girder structure is formed to reinforce the drilling load applied to the upper portion of the weather tight structure. Furthermore, it is possible to reduce time and cost necessary to install the weather tight structure 130, and the reinforcement structure of the weather tight structure 130 can be made not to disturb the drilling operation. In addition, the operational load and environmental load that may be generated during the drilling operation can be tolerated by the reinforcement part 133 of the weather tight structure 130. Therefore, it is unnecessary to install a separate structural reinforcement member for the drilling workspace in the polar regions. Moreover, the drilling workspace in the polar regions can be effectively ensured and the spatial limitation of the upper zone of the moonpool 160 can be prevented.

According to the present invention, it is possible to economically and easily manufacture the weather tight structure which minimizes the influence of outside air on the drilling operation in the polar regions, and it is possible to efficiently support the hull longitudinal strength and the weather tight structure with the use of the side strake structure solely. Therefore, a structure which may cause a disturbance in the drilling work area is minimized, and it is unnecessary to install a separate structural reinforcement member for a drilling workspace in the polar regions. In addition, the drilling workspace in the polar regions can be effectively ensured, and a spatial limitation in an upper portion of a moonpool can be solved.

Furthermore, since the upper structure coupled to the side strake structure can form the grillage girder system with the front and rear walls of the weather tight structure, it is possible to reinforce the drilling load applied to the upper structure (e.g., the drill floor).

While the embodiments of the present invention have been described with reference to the specific embodiments, it will be apparent to those skilled in the art that various changes and modifications may be made without departing from the spirit and scope of the invention as defined in the following claims.

What is claimed is:

1. An arctic drill ship, comprising:

a hull comprising a bottom, a left strake and a right strake;

a moonpool formed through the bottom;

a hurricane deck formed over the hull and having an opening for accessing the moonpool;

a drill floor formed over the hurricane deck;

a derrick fixed to and supported by the drill floor;

a weather tight structure comprising a front wall, a rear wall, a left extension wall a right extension wall which in combination surround the opening and define a drilling work area over the opening;

the left extension wall coupled to the left strake and extending upwardly from the left strake of the hull;

the right extension wall coupled to the right strake and extending upwardly from the right strake of the hull;

the front wall coupled to the hurricane deck and extending upwardly from the hurricane deck;

the rear wall coupled to the hurricane deck and extending upwardly from the hurricane deck;

a top cover placed over the drill floor and comprising edges coupled to the front wall, the rear wall, the left extension wall and the right extension wall such that the weather tight structure protects the drill floor from outside air;

the drill floor comprising edges that contact the front wall, the rear wall, the left extension wall and the right extension.

2. The arctic drill ship according to claim 1, wherein the drill floor extends laterally to contact the left and right extension walls such that the drill floor's width corresponds to a width of a hull in a cross-section taken by a plane crossing the left and side strakes.

3. The arctic drill ship according to claim 1, wherein the left wall has a bottom coupled to the left strake.

4. The arctic drill ship according to claim 1, wherein the left extension wall of the weather tight structure is directly supported by the left strake and the right extension wall of the weather tight structure is directly supported by the right strake.

5. The arctic drill ship according to claim 1, wherein the edges of the drill floor comprises a left edge contacting an upper portion of the left extension wall and a right edge contacting an upper portion of the right extension wall.

6. The arctic drill ship according to claim 1, wherein the edges of the drill floor comprises a front edge contacting an upper portion of the front wall and a rear edge contacting an upper portion of the rear wall.

7. The arctic drill ship according to claim 1, wherein the edges of the drill floor comprises a left edge contacting an upper portion of the left extension wall and a right edge contacting an upper portion of the right extension wall, a front edge contacting an upper portion of the front wall and a rear edge contacting an upper portion of the rear wall.

* * * * *